US010542353B2

(12) United States Patent
Ungstrup

(10) Patent No.: US 10,542,353 B2
(45) Date of Patent: Jan. 21, 2020

(54) HEARING AID WITH ASSISTED NOISE SUPPRESSION

(71) Applicant: WIDEX A/S, Lynge (DK)

(72) Inventor: Michael Ungstrup, Allerod (DK)

(73) Assignee: Widex A/S, Lynge (DK)

( * ) Notice: Subject to any disclaimer, the term of this patent is extended or adjusted under 35 U.S.C. 154(b) by 355 days.

(21) Appl. No.: 15/244,043

(22) Filed: Aug. 23, 2016

(65) Prior Publication Data

US 2016/0360327 A1 Dec. 8, 2016

Related U.S. Application Data

(63) Continuation-in-part of application No. PCT/EP2014/053505, filed on Feb. 24, 2014.

(51) Int. Cl.
*H04R 25/00* (2006.01)
*G10L 25/54* (2013.01)

(52) U.S. Cl.
CPC ..... *H04R 25/505* (2013.01); *G10L 25/54* (2013.01); *H04R 25/554* (2013.01);
(Continued)

(58) Field of Classification Search
CPC .... H04R 25/55; H04R 25/505; H04R 25/554; H04R 2225/41; H04R 2225/43; H04R 2225/55; H04R 2460/01; G10L 25/54
See application file for complete search history.

(56) References Cited

U.S. PATENT DOCUMENTS 5,721,783 A * 2/1998 Anderson ..... H04B 1/385 381/328
5,848,163 A * 12/1998 Gopalakrishnan ..... G10L 21/0208 381/56

(Continued)

FOREIGN PATENT DOCUMENTS

EP 1 296 537 A2 3/2003
EP 1 307 833 A2 5/2003

(Continued)

OTHER PUBLICATIONS

International Preliminary Report on Patentability dated Sep. 16, 2014, issued in International Application No. PCT/EP2012/054202.

(Continued)

*Primary Examiner* — Matthew A Eason
*Assistant Examiner* — Taunya McCarty
(74) *Attorney, Agent, or Firm* — Sughrue Mion, PLLC

(57) ABSTRACT

An input transducer (11, 12) of a hearing aid (10) converts audio from the environment into an electric input signal. A signal processor (13) amplifies and conditions the electric input signal according to a preset set of audio processing parameters, and an output transducer (14) reproduces output audio. The hearing aid (10) is connected with a personal communication device (20) via a short range radio communication link (15, 29). The personal communication device (20) identifies music included in the background noise. The personal communication device (20) retrieves a music stream based on the identified music, and streams the music stream to the hearing aid (10). The signal processor (13) of the hearing aid (10) combines the input signal from the input transducer (11, 12) and music signal in order to reduce the presence of the music included in the background noise from the audio signal delivered by the output transducer (14).

11 Claims, 4 Drawing Sheets

(52) U.S. Cl.
CPC ..... *H04R 2225/41* (2013.01); *H04R 2225/43* (2013.01); *H04R 2225/55* (2013.01); *H04R 2460/01* (2013.01)

(56) References Cited

U.S. PATENT DOCUMENTS

| | | | | |
|---|---|---|---|---|
| 6,597,792 | B1 | 7/2003 | Sapiejewski et al. | |
| 7,676,352 | B1 | 3/2010 | Van Peursem et al. | |
| 7,853,664 | B1 | 12/2010 | Wang et al. | |
| 8,290,423 | B2 | 10/2012 | Wang | |
| 9,451,370 | B2 | 9/2016 | Hasler et al. | |
| 2003/0044033 | A1 | 3/2003 | Julstrom et al. | |
| 2003/0118197 | A1 | 6/2003 | Nagayasu et al. | |
| 2005/0117713 | A1 | 6/2005 | Waldron et al. | |
| 2005/0175202 | A1 | 8/2005 | Moo et al. | |
| 2005/0283263 | A1* | 12/2005 | Eaton | H04R 25/70 700/94 |
| 2007/0082612 | A1* | 4/2007 | Valve | H04M 1/6008 455/41.2 |
| 2008/0137873 | A1* | 6/2008 | Goldstein | H04R 1/1016 381/57 |
| 2008/0192969 | A1* | 8/2008 | Welner | H04R 25/502 381/314 |
| 2009/0034768 | A1* | 2/2009 | Lunner | H04R 25/453 381/318 |
| 2009/0076804 | A1* | 3/2009 | Bradford | H04R 25/552 704/203 |
| 2009/0202091 | A1 | 8/2009 | Pedersen et al. | |
| 2009/0208043 | A1* | 8/2009 | Woods | H04R 25/558 381/315 |
| 2009/0268933 | A1* | 10/2009 | Baechler | H04R 25/407 381/318 |
| 2011/0158420 | A1* | 6/2011 | Hannah | H04R 1/105 381/71.6 |
| 2011/0243339 | A1 | 10/2011 | Ang et al. | |
| 2011/0250932 | A1* | 10/2011 | Cohen | H04R 1/1016 455/569.1 |
| 2012/0033827 | A1* | 2/2012 | Murata | G10K 11/1782 381/94.1 |
| 2012/0209612 | A1* | 8/2012 | Bilobrov | G11B 27/28 704/270 |
| 2013/0137480 | A1* | 5/2013 | Heiman | H04M 1/19 455/550.1 |
| 2013/0142369 | A1* | 6/2013 | Zhang | H04R 25/45 381/317 |
| 2013/0262101 | A1* | 10/2013 | Srinivasan | G10L 21/0208 704/226 |
| 2013/0318114 | A1 | 11/2013 | Emerson, III | |
| 2014/0193007 | A1* | 7/2014 | Solum | H04R 25/40 381/313 |

FOREIGN PATENT DOCUMENTS

| | | | | |
|---|---|---|---|---|
| EP | 2 611 215 | A1 | 7/2013 | |
| WO | 01/52141 | A1 | 7/2001 | |
| WO | 2008/071236 | A2 | 6/2008 | |
| WO | 2008/128563 | A1 | 10/2008 | |
| WO | 2009/049645 | A1 | 4/2009 | |
| WO | 2010/0086462 | A2 | 8/2010 | |
| WO | WO 2011159349 | A1 * | 12/2011 | H04R 25/55 |
| WO | 2013/135263 | A1 | 9/2013 | |

OTHER PUBLICATIONS

International Search Report dated Oct. 25, 2012 in International Application No. PCT/EP2012/054204.

Izel M. Taylor, Ph.D., et al., "Simulated Reverberation and Hearing Aids", Hearing Aid Research Lab (HARL), American Academy of Audiology National Convention, 1996, 1 page, Salt Lake City, Utah.

International Search Report for PCT/EP2014/053505 dated Sep. 24, 2014 [PCT/ISA/210].

Written Opinion for PCT/EP2014/053505 dated Sep. 24, 2014 [PCT/ISA/210].

* cited by examiner

HEARING AID WITH ASSISTED NOISE SUPPRESSION

RELATED APPLICATIONS

The present application is a continuation-in-part of application No. PCT/EP2014/053505, filed on Feb. 24, 2014, in Europe and published as WO2015124211 A1.

1. FIELD OF THE INVENTION

The present invention relates to hearing aids. The invention, more particularly, relates to a hearing system for improving the speech intelligibility of a hearing aid user in a public place with music included in the background noise. The hearing system includes a hearing aid and a personal communication device. Also, the invention relates to a method of suppressing the noise level experienced by a hearing aid user in a public place with music included in the background noise. Furthermore the invention relates to a computer-readable storage medium having computer-executable instructions carrying out the method according to the invention when executed in a personal communication device.

2. BACKGROUND OF THE INVENTION

Basically, a hearing aid has a microphone for converting sound into an electric signal, an amplifier for alleviating the hearing loss of the user and a receiver for converting the amplified electric signal into sound again. Modern, digital hearing aids comprise sophisticated and complex signal processing units for processing and amplifying sound according to a prescription aimed at alleviating a hearing loss for a hearing impaired individual. The major purpose of a hearing aid is to improve speech intelligibility.

State of art hearing aids have features for recognizing speech and suppressing noise in an audio signal picked up by the hearing aid. A useful element in the statistical analyses is percentile levels. Hearing aids are able to assume various modes in dependence of the detected sound environment, and when music is included in the background noise, the microphone assembly of the hearing aid may become directional in order to suppress noise from offset directions.

SUMMARY OF THE INVENTION

The purpose of the invention is to provide a hearing system for improving the speech intelligibility of a hearing aid user in a public place with music included in the background noise. Music has been found to have a psychological effect on the listeners to get them feel comfortable and to provide some kind of intimacy as an individual outside a group cannot follow the conversation.

A hearing system according to the invention comprises in a first aspect a hearing aid and a personal communication device, where the hearing aid and the personal communication device both including a short range data transceiver for providing a short range data communication link. The hearing aid includes an input transducer picking up an audio signal from the environment and providing an electric input signal accordingly, a signal processor processing an electric input signal according to audio processing parameters of the hearing aid, and an output transducer providing an output audio signal based upon the processed electric signal. The personal communication device includes a processing unit adapted for retrieving a music stream signal corresponding to the music present in the background noise, and the processing unit adapted to stream the music stream signal to the hearing aid via said short range radio communication link. The signal processor of the hearing aid is able to combine the input signal from the input transducer and the music stream signal of the personal communication device in order to reduce the prevalence of the music included in the background noise from the output audio signal delivered by the output transducer.

The hearing system according to the invention identifies music present in background noise which may occur in café's, restaurants and shopping malls. By subtracting a clean music signal from the audio picked up by the hearing aid, an improvement of the signal-to-noise ratio of the hearing aid in certain environments can be improved by approximately 6 dB.

The short range radio transceivers of the hearing aid and the personal communication device both are advantageously based upon a Bluetooth™ Core Specification, preferably the Bluetooth Core Specification version 4.0—also known as Bluetooth Low Energy.

A method according to a second aspect of the invention includes suppressing the noise level experienced by a hearing aid user in a public place with music included in the background noise, where the hearing aid includes an input transducer picking up an audio signal from the environment and providing an electric input signal accordingly, a signal processor processing an electric input signal according to audio processing parameters of the hearing aid, and an output transducer providing an output audio signal based upon the processed electric signal. The method comprises steps of connecting a hearing aid and a personal communication device both having a short range radio transceiver for providing a short range radio communication link, retrieving a music stream signal corresponding to the music present in the background noise, streaming the music stream signal to the hearing aid via said short range radio communication link, and combining the input signal picked up by the input transducer of the hearing aid and the music stream signal in order to reduce the prevalence of the music included in the background noise of the output audio signal delivered by the output transducer.

A hearing aid according to a third aspect of the invention has an input transducer picking up an audio signal from the environment and providing an electric input signal accordingly, a signal processor processing an electric input signal according to audio processing parameters of the hearing aid, an output transducer providing an output audio signal based upon the processed electric signal, a short range radio transceiver for providing a short range radio communication link with a personal communication device, said personal communication device being adapted to stream a music stream signal to the hearing aid via said short range radio communication link, and the signal processor of the hearing aid being adapted to combine the input signal from the input transducer and music stream signal of the personal communication device in order to reduce the prevalence of the music included in the background noise from the output audio signal delivered by the output transducer.

In a fourth aspect, the invention provides a computer-readable storage medium having computer-executable instructions, which when executed in a personal communication device pair the personal communication device with a hearing aid for connecting the hearing aid and the personal communication device via a short range radio communication link, retrieve a music stream signal corresponding to the music present in the background noise, and stream the music stream signal to the hearing aid via said short range radio communication link.

A personal communication device according to a fifth aspect of the invention has a short range data transceiver for providing a short range data communication link for communication with a hearing aid. The personal communication device includes a processing unit adapted to pair the personal communication device with a hearing aid for connecting the hearing aid and the personal communication device via a short range radio communication link, and the processing unit has a component adapted to retrieve a music stream signal corresponding to the music present in the background noise, and to stream the music stream signal to the hearing aid via said short range radio communication link.

BRIEF DESCRIPTION OF THE DRAWINGS

The invention will be described in further detail with reference to preferred aspects and the accompanying drawing, in which.

DETAILED DESCRIPTION OF THE INVENTION

Figure 1:
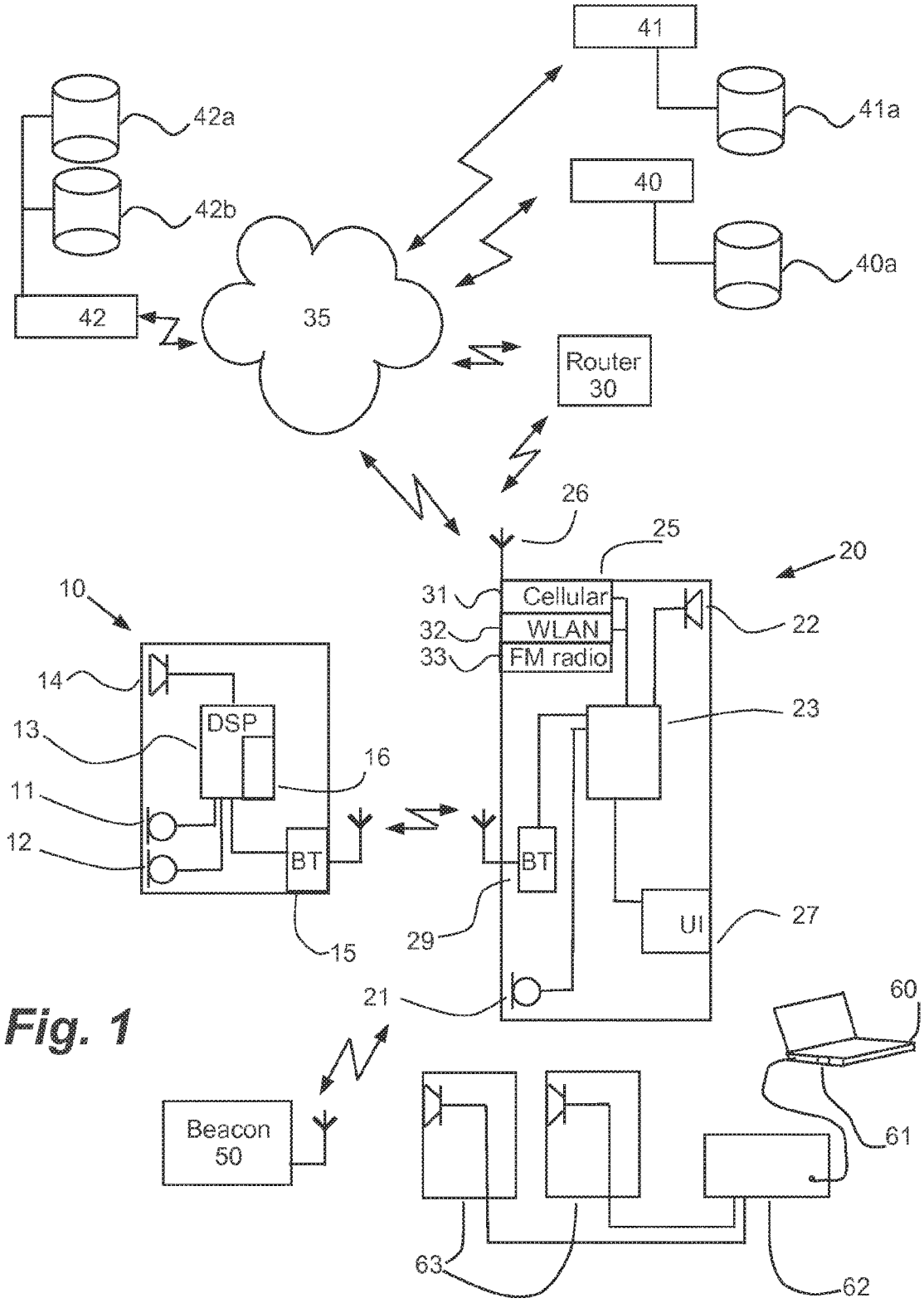
FIG. 1 illustrates schematically a hearing aid system according to an embodiment of the invention.

Reference is made to FIG. 1, which schematically illustrates a hearing system according to an embodiment of the invention. Prior to use, the settings of the hearing aid are set and adjusted by a hearing care professional according to a prescription. The prescription is preferably provided by an audiologist and is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit.

A hearing aid 10 comprises two input transducers 11, 12 for picking up the acoustic sound and converting it into electric signals. The electric signals from the two transducers 11, 12 are led to a Digital Signal Processing (DSP) unit 13 for amplification and conditioning according to a predetermined setting set by an audiologist. An advantage of having a dual microphone system is that it makes it possible to perform spatial filtering. The input signal is preferably split into a number of narrow frequency bands which can then be processed individually. The Digital Signal Processing (DSP) unit 13 delivers an amplified and conditioned electrical output signal to a speaker or an output transducer 14. Preferably Delta-Sigma-conversion is applied in the signal processing so the electrical output signal is formed as a one-bit digital data stream fed directly to the output transducer 14, whereby the hearing aid 10 drives the output transducer 14 as a class D amplifier. The hearing aid 10 includes a standard hearing aid battery (not shown) as power supply and may in addition also include a telecoil (not shown) for picking up a broadcasted electromagnetic signal.

The Digital Signal Processing (DSP) unit 13 includes an automatic program selector component 16 that analyzes the incoming audio signal and selects an appropriate hearing aid program accordingly. This hearing aid program applies various algorithms for spatial filtering, improving speech intelligibility etc., depending on the current noise environment. Furthermore, the hearing aid 10 includes a connectivity component 15 for communication with a personal communication device 20. The connectivity component 15 operates preferably according to the Bluetooth Core Specification version 4.0—also known as Bluetooth Low Energy. Such connectivity components 15 are commercially available as a dedicated chip from various manufacturers, and by including such a component into a hearing aid, it becomes possible to connect the hearing aid to the Internet via a connection to a smartphone, a tablet computer or other types of external communication devices and to get the benefits from such a connection. However other short range communication standards may be applicable.

According to the invention, the personal communication device 20 includes a connectivity component 29 that may communicate with the hearing aid 10 and therefor operates under the same short range communication standard, preferably the Bluetooth Core Specification, version 4.0.

Often a hearing aid user will carry a pair of binaural hearing aids, but for clarity reasons one is shown in FIG. 1.

The personal communication device 20 includes a User Interface (UI) 27, such as a touch display (Graphical User Interface), presenting content, input screens, and notifications to the user and allowing the user to input instructions and commands.

The personal communication device 20 may be a mobile phone having a microphone 21, a speaker 22, and a processor 23 controlling the operation. The personal communication device 20 is intended to provide the user a wide variety of communication services, and for this purpose the personal communication device 20 includes a wireless transceiver, such as a Radio Frequency (RF) component 25 and a corresponding antenna module 26. The RF component 25 is controlled by the system software run on the processor 23 and includes a cellular part 31 for communication (mobile phone calls and data connection) over a cellular network—whereby the personal communication device 20 is able to connect to the Internet 35 via a cellular network (not shown).

The RF component 25 may furthermore include a WLAN modem 32 preferably operating according to the IEEE 802.11 protocol. Hereby the personal communication device 20 is able to connect to the Internet 35 via a WLAN network router 30.

The personal communication device 20 includes, in the embodiment illustrated in FIG. 1, an FM Radio receiver 33.

The user of the personal communication device 20 may via the User Interface 27 instruct the personal communication device 20 to access an external server 40 via the Internet 35, and download an application software (app) program dedicated for the hearing aid 10.

When run on the personal communication device 20, the application software may preferably also act as an assisting classifier. The classifier 16 of the hearing aid 10 analyses the auditory environment, while the assisting classifier analyses the current time, the user position and behavior. The assisting classifier may extract the position data from the connectivity manager of the personal communication device 20, and share this information with the classifier 16 via the short range radio communication links provided by the two connectivity components 15 and 29. Thereby the classifier 16 will provide a more qualified hearing aid program selection.

Apple Inc. has promoted an indoor positioning system called iBeacon™. The technology is able to notify a mobile device and provide relevant informations. The iBeacon works on Bluetooth™ Low Energy. A beacon device 50 operating under the Bluetooth™ Low Energy specification can be regarded as a location-aware, context-aware, pervasive small wireless sensor beacon that could pinpoint a person's location and offer services associated with this location. The beacon device 50 pushes the information or provides the informations upon request. The hearing aid client application software present in the personal communication device 20 uses these data when present.

When you as a hearing impaired person enter an environment with background music, the hearing aid will by means of the classifier 16 be able to recognize the sound environment as being music, but the classifier 16 is of course not able to guess whether the hearing impaired person intends to listen to the music (music is desired) or intends to participate in a conversation (music is undesired) in e.g. a café. Therefor there is a need for a method to suppress the noise level experienced by a hearing aid user e.g. in a public place with music included in the background noise.

According to the invention, there is provided a method of suppressing the noise level experienced by a hearing aid user e.g. in a public place with music included in the background noise. The hearing aid 10 includes at least one input transducer 11, 12 picking up an audio signal from the environment and providing an electric input signal accordingly. The signal processor—here the Digital Signal Processing (DSP) unit 13—processes the electric input signal according to audio processing parameters of the hearing aid 10, and an output transducer 14 provides an output audio signal based upon the processed electric signal.

When the hearing aid 10 and the personal communication device 20 are connected by means of respective short range radio transceivers 15, 29 for providing the short range radio communication link, the personal communication device 20 retrieves according to the invention a music stream signal corresponding to the music present in the background noise, and streams the music stream signal to the hearing aid 10 via said short range radio communication link.

Figure 3:
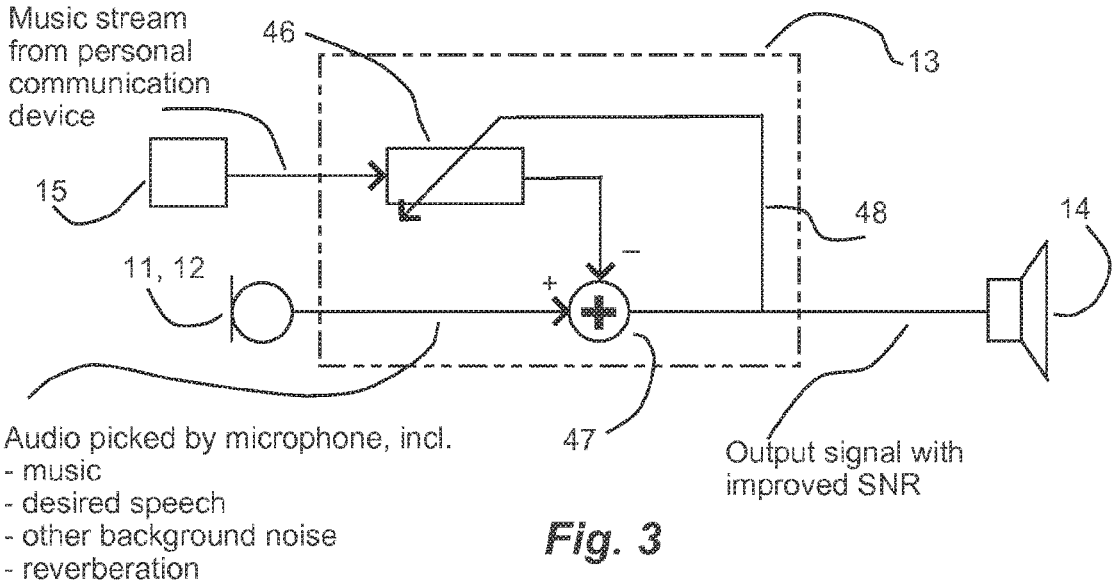
FIG. 3 shows schematically the audio paths of the hearing aid according to one embodiment of the invention.

Once the hearing aid 10 receives the streamed music stream signal, the Digital Signal Processing (DSP) unit 13 combines—as shown in FIG. 3—the input signal picked up by the input transducer 11, 12 of the hearing aid 10 and the music stream signal in order to reduce or cancel the prevalence of the music included in the background noise in the output audio signal delivered by the output transducer 14.

Figure 2:
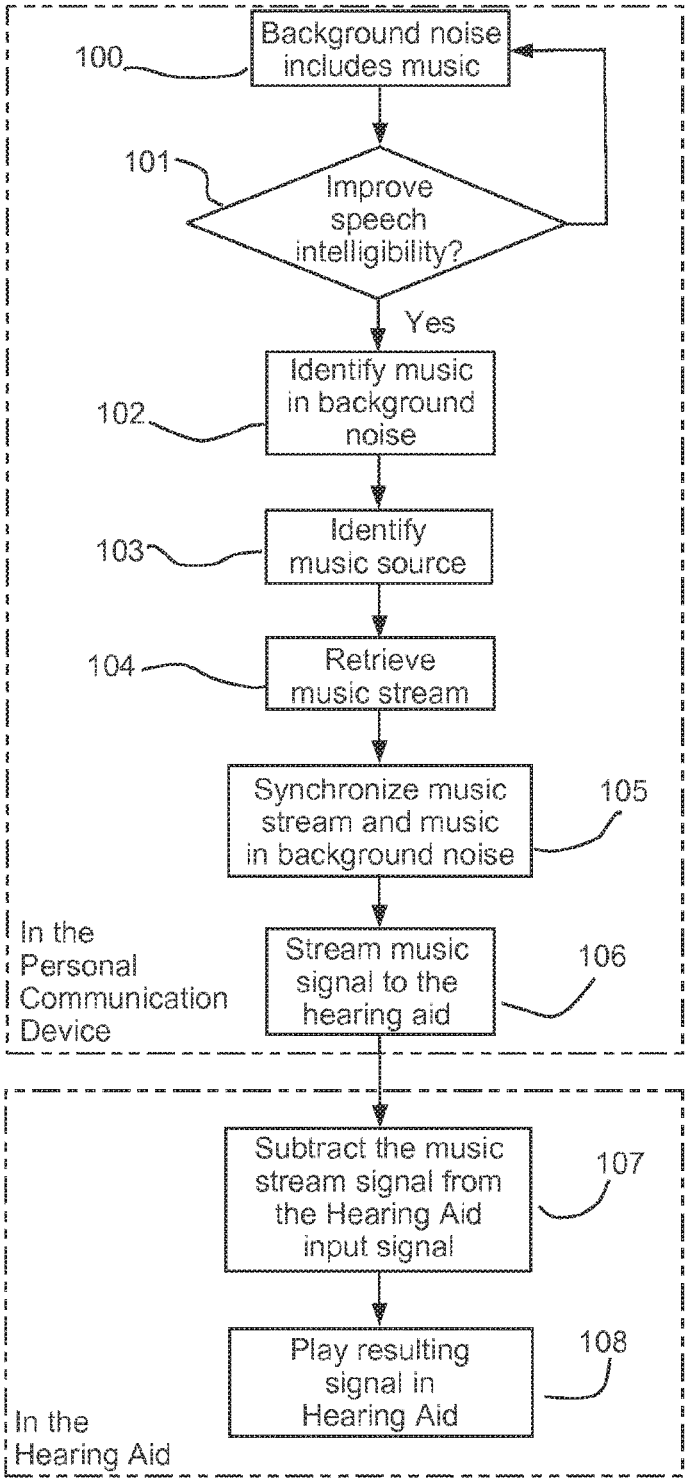
FIG. 2 is a flow chart showing one embodiment of a method for suppressing the noise level experienced by a hearing aid user in a public place with music included in the background noise.
Figure 5:
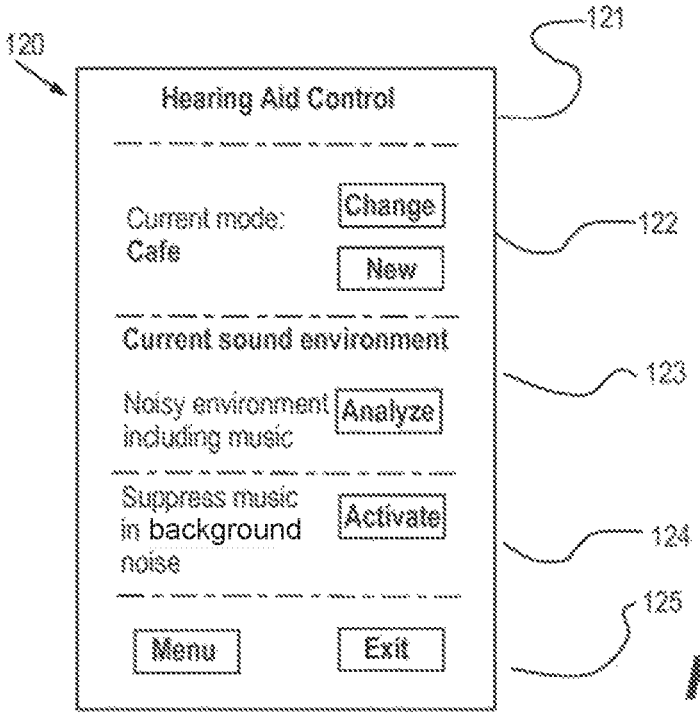
FIG. 5 illustrates one embodiment of the user interface for application software for controlling a hearing aid and for suppressing music included in the background noise.

A first embodiment of the invention will be described with reference to FIGS. 2 and 5. When the hearing aid user enters a noisy environment with background music in step 100, the personal communication device 20 may detect the noisy environment by itself, or the user may have to open the hearing aid app manually, e.g. by using the graphical user interface 120 (FIG. 5), having a header 121 identifying the hearing aid app. The hearing aid app has a mode selection section 122, from which the current mode: "Café"—either selected manually or automatically—appears. Via a "change" control in the mode selection section 122, the hearing aid user may change the current hearing aid program to another hearing aid program available from a selection list (not shown) appearing when the "change" control is activated. Furthermore, the user may create a new hearing aid program by activating a "new" control in the mode selection section 122, where a guiding screen (not shown) will assist the hearing aid user to set up the new hearing aid program. In the bottom of the graphical user interface 120, a section 125 has two controls—one for closing the app and one for providing access to further menu items, such as identification of streaming sources.

The hearing aid app has a sound environment analyzing section 123 with an "Analyze" control. When the "Analyze" control is activated, the personal communication device 20 accesses a commercially available mobile phone-based music identification service via the Internet 35. Such a service may be provided by Shazam Entertainment Ltd. Shazam® uses the built-in microphone 21 to gather a brief sample of music being played, and the personal communication device 20 creates an acoustic fingerprint based on the sample, and uploads this acoustic fingerprint to a remote server 40*a* where it is compared against a central database 41*a* for a match. The finger printing software included in the hearing aid app running on the personal communication device 20 uses parameters like frequency, intensity, and time for creating a virtual map of peaks and anchor points for this kind of attributes. If a match is found, information such as the artist, song title, and album, are relayed back to the user including relevant links to services such as iTunes®, YouTube®, Spotify® or Zune®.

The hearing aid app has a music suppression section 124 with an "Activate" control. When the "Activate" control is activated, the personal communication device 20 starts a continuous music suppression procedure in step 101 for improving the speech intelligibility. In step 102 the music figuring in the background noise is identified, and a music source is identified in step 103. The music source identified is able to provide an electrical signal including the same music as appearing in the back ground signal. Once the music source has been identified, the personal communication device 20 requests—if required—a music stream, and starts in step 104 to retrieve an electrical signal including music played in the background noise. In step 105, the personal communication device 20 analyses the background noise and the retrieved electrical signal (streamed music) including music played in the background noise for matching characteristics of the audio samples in order to substantially synchronize the streamed music signal to the music contained in the background noise. Once this in place, the personal communication device 20 starts streaming the music signal via the short range data connection to the hearing aid 10 in step 106.

The hearing aid 10 receives the music stream from the personal communication device 20 via the short range radio transceiver 15. Once the music stream is received, the hearing aid 10 has, as seen from FIG. 3, two audio input signals—one picked by the microphones 11, 12 and one picked by the short range radio transceiver 15, and these two audio input signals are subtracted from each other in an adder 47, and the output from the adder 47 is via a feedback path 48 used to adjust an adaptive filter 46 in the path of the audio signal picked by the short range radio transceiver 15. This means that the adder 47 as subtractor component subtract the music stream signal (or a filtered version thereof) from the input signal picked by the microphones 11, 12. The adder 47, the adaptive filter 46 and the feedback path 48 will according to the preferred embodiment be included in the Digital Signal Processing (DSP) unit 13.

Figure 4:
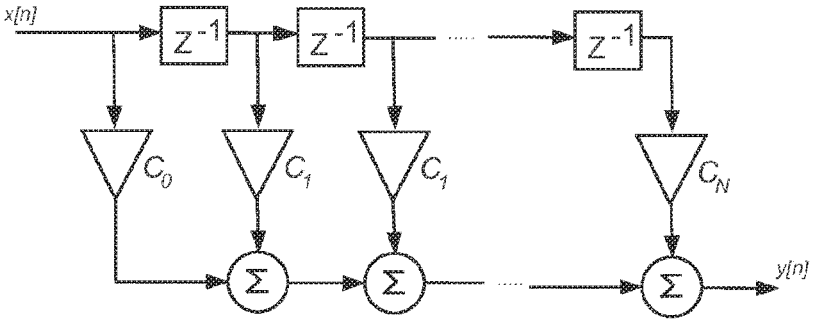
FIG. 4 shows schematically a discrete-time N'th order delay line FIR filter for use in the hearing aid according to one embodiment of the invention.

One embodiment of the adaptive filter 46 is shown in FIG. 4 as a discrete-time FIR filter of order N. The top part is an N-stage delay line with (N+1) taps. Each unit delay is a $z^{-1}$ operator in Z-transform notation. The output y[n] is a weighted sum of the current and a finite number of previous values of the input x[n]. The operation is described by the following equation, which defines the output sequence y[n] in terms of its input sequence x[n]:

$$y[n]=C_0x[n]+C_1x[n-1]+C_2x[n-2]+\ldots+C_Nx[n-N],$$

where:

x[n] is the input signal, y[n] is the output signal, $C_i$ are the filter coefficients, also known as tap weights, that make up the impulse response, and that are controlled in order to minimize a cost function based on the signal in the feedback path 48.

By minimizing a cost function of the output from the adder 47—often called the error signal—the adaptive filter 46 ensures that the two audio input signals handled by the hearing aid 10 are substantially synchronized, and the output signal from the adder 47 is substantially without contribution from the music present in the background noise. This signal played back via the speaker 14 for the hearing aid user in step 108 has a substantially improved Signal-to-Noise Ratio (SNR). Tests have shown an improved SNR in the level of 6 dB.

In the embodiment of the filter shown in FIG. 4, if the cost function is chosen to be the mean square error, i.e. the mean square of the signal in the feedback path 48, then the adaptive filter can result in the well-known Least-Mean-Square Algorithm. This algorithm is a member of the family of stochastic gradient algorithms, many of which can be applied to the present case. Indeed, there are other adaptive algorithms outside this family that may be applied, and these will be known to one skilled in the art. Some of these algorithms are detailed in the standard textbook Simon Haykin: Adaptive Filter Theory, third edition (1996), Prentice Hall.

The challenges of hearing aids in reverberant environments have been discussed in "Simulated Reverberation and Hearing Aids" by M. Izel et al, presented at the American Academy of Audiology National Convention 1996, Salt Lake City, Utah. By employing an adaptive filter 46 in the streaming path of the hearing aid in reverberant environments with multiple reflections of music present in the background noise, it has been observed that the setting of the filter coefficients, $C_i$, by means of the feedback path 48 will eliminate the reverberation effect caused by multi-path propagation of the music.

The hearing aid control app of the personal communication device 20 may use multiple music sources for providing a music stream corresponding to the music present in the background noise.

Two Remote Service Providers

According to the first embodiment the personal communication device 20 uploads the acoustic fingerprint of the music being played to the remote service provider 40 searching the database 40*a* for a match. The personal communication device 20 receives a relevant link to a music provider in response, and may request the music stream from a second service provider 41 in response, and starts downloading the music stream or file from an online music store database 41*a*. Then the audio processing works as described above. The challenge is the response time from starting looking for a match and until the streamed music has been synchronized, and that this procedure has to be repeated for every new piece of music.

One Remote Dedicated Service Provider

This scenario is very similar to the scenario with two service providers as discussed above. The difference is that the personal communication device 20 uploads the acoustic fingerprint of music being played to a remote service provider 42 searching the database 42*a* for a match, and the service provider streams a music stream from his own online music database 42*b* in response. The user gains some seconds in response time every time he looks for a match.

According to an alternative embodiment, the audio sample including the background noise is picked up by means of the microphone 11, 12 of the hearing aid 10, and streamed from the hearing aid 10 to the personal communication device 20 for defining the acoustic fingerprint. This may be an advantageously when the music played in the background has to be identified track by track, and the hearing aid user wants to keep his smartphone or personal communication device 20 in his bag or pocket. The user may control this way of operation by setting a parameter, or the personal communication device 20 may monitor the quality of sound samples picked up by both devices and choose the best.

In order to ensure a smooth operation of the system, the hearing aid control app of the personal communication device 20 has to be able to automatically detect when a new song or track starts, and it may include an algorithm calculating when the subsequent song begins. Then it can start to search for a new match. The hearing aid control app of the personal communication device 20 predicts when the current song is expected to end based on knowing the duration of the track, and the correlation between the two signals (microphone and streaming). As music becomes dominating in the output from the adder 47, the hearing aid 10 may also analyze this signal in order to detect the start of a new song or track.

Beacon Assisted Music Streaming

According to a further embodiment of the invention, the operator of the location playing the background music may assist a hearing impaired person by means of the beacon device 50. The beacon device 50 may offer the user assistance services associated with this current location. As the personal communication device 20 and the beacon device 50 both operates under Bluetooth™ Low Energy, the beacon device 50 may inform the personal communication device 20 about the source of the background music. Many bars and restaurants do nowadays use a computer (or a laptop) 60 (as shown in FIG. 1) connected to the internet as music player. By installing a client program on the computer 60, the operator may stream music via a playlist such as Spotify®, which is a commercial music streaming service where the users pay a monthly subscription fee.

The beacon device 50 may therefor inform the personal communication device 20 that the music source is the streaming service, e.g. Spotify®, and also identify the currently used playlist and preferably also the currently played track. Having these informations, the personal communication device 20 acquires its own audio stream via WLAN or cellular data as explained above, provided that the personal communication device 20 has a client program installed. Once the personal communication device 20 has established the retrieval of a music stream signal corresponding to the music present in the background noise, it starts streaming the music stream signal to the hearing aid 10 via the short range radio communication link. The hearing aid 10 then subtracts the music stream signal from the input signal picked up by the input transducer 11, 12 in order to reduce the presence of the music included in the background noise of the output audio signal delivered by the output transducer 14.

The computer 60 is via a cable connected to a music (hi-fi) amplifier 62 driving two or more speakers 63 in the room. A plug-in devices 61 corresponding to the beacon device 50 is connected to the computer 60 via e.g. an USB connector, and according to a yet further aspect of the invention, the computer 60 establishes upon request from the personal communication device 20 a Wi-Fi hotspot by means of a WLAN transceiver of the computer 60 or in the plug-in devices 61. This Wi-Fi hotspot may be dedicated to transmit a music stream signal corresponding to the music present in the background noise to personal communication devices 20 in it vicinity, which again stream the music stream signal to the hearing aid 10, and the hearing aid 10 then reduces the prevalence of the music included in the background noise of the output audio signal delivered by the output transducer 14.

According to yet another embodiment, the plug-in devices 61 includes a Wireless USB FM Transmitter being able to transmit a music stream signal corresponding to the music present in the background noise to personal communication devices 20 in it vicinity by means of a low power FM radio transmitter. The personal communication device 20 may then receive the music stream signal similar to an ordinary FM radio station. The necessary informations are delivered by the plug-in devices 61, and once the stream has been received, the personal communication device 20 starts streaming the music stream signal to the hearing aid 10, and the hearing aid 10 then reduces the presence of the music included in the background noise of the output audio signal delivered by the output transducer 14.

The benefit of using local transmission of the music stream from a computer 60 to the personal communication device 20 of streaming music streaming a music stream based on a played play list is that the personal communication device 20 does not have to identify the music tracks individually, whereby the noise reduction runs as a continuous process once the recognition, streaming and synchronization has been established.

According to a yet further embodiment, beacon-assisted music streaming is streamed directly to the hearing aid 10. Bluetooth® standardization work plans broadcasting audio to multiple hearing aid users. This can be used for public announcements, but will also be useful in e.g. a restaurant for noise suppression. Alternatively, the audio streaming for noise suppression may take place by means of a telecoil of the hearing aids, where the beacon informs the hearing aid 10 and/or the personal communication device 20 that the audio streaming for noise suppression will be available on the telecoil.

For beacon-assisted music streaming it may be important to match the microphone signal time-wise with the streamed signal. As some radio systems may introduce a non-negligible delay, it is important to synchronize the microphone signal and the streamed signal by introducing a delay compensation which will be evident for a man skilled in the art.

I claim:

1. A hearing system including a hearing aid and a personal communication device for improving speech intelligibility for a hearing aid user in a public place with music included in the background noise, said hearing aid including:

an input transducer picking up an audio signal from the environment and providing an electric input signal accordingly;

a signal processor processing an electric input signal according to audio processing parameters of the hearing aid, and outputting a processed electric signal;

an output transducer providing an output audio signal based upon the processed electric signal; and a short-range radio transceiver for providing a short-range radio communication link;

said personal communication device including:

a processing unit adapted for retrieving a music stream signal corresponding to the music present in the background noise; and a short-range radio transceiver for providing a short-range radio communication link;

said processing unit adapted to stream the music stream signal to the hearing aid via said short range radio communication link; and wherein the signal processor of the hearing aid is adapted to combine the input signal from the input transducer and the music stream signal of the personal communication device in order to reduce the prevalence of the music included in the background noise from the output audio signal delivered by the output transducer, wherein the signal processor of the hearing aid includes:

a subtractor component subtracting the music stream signal from the input signal; and a digital filter synchronizing the music stream signal relatively to the input signal by minimizing a cost function based on the output from the subtractor component.

2. The hearing system according to claim 1, wherein said personal communication device further includes:

a second radio transceiver providing access for data communication with a remote server via the Internet, said remote server being adapted to identify music by comparing an acoustic fingerprint based on an audio signal to a database of recordings, and to provide a music identification response accordingly; and said processing unit being adapted to create an acoustic fingerprint based on an audio signal sample from the environment for upload to said remote server, and to receive said music identification response.

3. The hearing system according to claim 1, wherein the digital filter is a discrete-time finite impulse response (FIR) filter of order N.

4. The hearing system according to claim 1, wherein the processing unit of the personal communication device includes a source selection component selecting the source for the music stream signal in dependence on music that has been identified in the background noise.

5. A method of operating the hearing aid system of claim 1 to suppress the noise level experienced by a hearing aid user in a public place with music included in the background noise, said method comprising steps of:

connecting said hearing aid and said personal communication device via said short range radio communication link;

retrieving said music stream signal corresponding to the music present in the background noise;

streaming the music stream signal to the hearing aid via said short range radio communication link; and combining the input signal picked up by the input transducer of the hearing aid and the music stream signal in order to reduce the prevalence of the music included in the background noise of the output audio signal delivered by the output transducer, wherein the step of combining the input signal and the music stream signal includes subtracting the music stream signal from the input signal;

wherein the step of combining the input signal and the music stream signal includes synchronizing the music stream signal relatively to the input signal by minimizing a cost function based on the output from the subtractor component.

6. The method according to claim 5, wherein the step of retrieving a music stream signal corresponding to the music present in the background noise includes:

providing an acoustic fingerprint based on an audio signal sample from the environment;

uploading said acoustic fingerprint to a remote server adapted to identify music by comparing the acoustic fingerprint to a database of recordings;

receiving a music identification response from said remote server in response to the uploaded acoustic fingerprint; and retrieving a music stream signal based on the received music identification response.

7. The method according to claim 5, characterized in further comprising selecting a source for the music stream signal in dependence on music that has been identified in the background noise.

8. A hearing aid for improving speech intelligibility for a hearing aid user in a public place with music included in the background noise, and including:

an input transducer picking up an audio signal from the environment and providing an electric input signal accordingly;

a signal processor processing an electric input signal according to audio processing parameters of the hearing aid, and outputting a processed electric signal;

an output transducer providing an output audio signal based upon the processed electric signal; and a short-range radio transceiver for providing a short-range radio communication link for receiving a music stream signal corresponding to the music present in the background noise; and wherein the signal processor is adapted to combine the music stream signal and the input signal from the input transducer signal of the personal communication device in order to reduce the prevalence of the music included in the background noise from the output audio signal delivered by the output transducer;

wherein the signal processor of the hearing aid includes:

a subtractor component subtracting the music stream signal from the input signal; and a digital filter synchronizing the music stream signal relatively to the input signal by minimizing a cost function based on the output from the subtractor component.

9. The hearing system according to claim 1, wherein the music stream signal retrieved by said processing unit corresponds to music that has been determined by said personal communication device to be present in the background noise.

10. The hearing aid according to claim 8, wherein the music stream signal received by the short-range radio transceiver corresponds to music present in the background noise having been determined by a personal communication device.

11. The hearing aid according to claim 8, wherein the digital filter is a discrete-time finite impulse response (FIR) filter of order N.

* * * * *